US007355500B2

(12) United States Patent
Vom Schloss et al.

(10) Patent No.: US 7,355,500 B2
(45) Date of Patent: Apr. 8, 2008

(54) ATTACHABLE ROD IGNITION COIL

(75) Inventors: Andreas Vom Schloss, Gaimersheim (DE); Bernhard Stock, Adelschlag (DE)

(73) Assignee: Audi AG (DE)

( * ) Notice: Subject to any disclaimer, the term of this patent is extended or adjusted under 35 U.S.C. 154(b) by 58 days.

(21) Appl. No.: 10/551,044

(22) PCT Filed: Mar. 17, 2004

(86) PCT No.: PCT/EP2004/002759

§ 371 (c)(1),
(2), (4) Date: Sep. 27, 2005

(87) PCT Pub. No.: WO2004/085837

PCT Pub. Date: Oct. 7, 2004

(65) Prior Publication Data

US 2006/0214757 A1 Sep. 28, 2006

(30) Foreign Application Priority Data

Mar. 28, 2003 (DE) ..... 103 14 063

(51) Int. Cl.
*H01F 27/28* (2006.01)

(52) U.S. Cl. ..... 336/192

(58) Field of Classification Search ..... 336/90, 336/92, 107, 192; 123/634–635
See application file for complete search history.

(56) References Cited

U.S. PATENT DOCUMENTS

| | | | | |
|---|---|---|---|---|
| 4,090,125 | A | 5/1978 | Warner | |
| 4,277,724 | A | 7/1981 | Beeghly | |
| 4,446,842 | A * | 5/1984 | Iwasaki | 123/606 |
| 5,535,726 | A | 7/1996 | Wilmot et al. | |
| 5,547,387 | A * | 8/1996 | Kobayashi | 439/125 |
| 5,685,282 | A | 11/1997 | Murata et al. | |
| 6,192,873 | B1 | 2/2001 | Adachi et al. | |
| 6,491,531 | B1 | 12/2002 | Reinmueller et al. | |
| 6,926,266 | B1 * | 8/2005 | Paul et al. | 267/174 |
| 2001/0045800 | A1 | 11/2001 | Hamada et al. | |

FOREIGN PATENT DOCUMENTS

DE 199 31 979 1/2001

* cited by examiner

*Primary Examiner*—Tuyen T. Nguyen
(74) *Attorney, Agent, or Firm*—Peter N. Lalos

(57) ABSTRACT

The invention relates to an attachable rod ignition coil comprising an ignition coil part and an adapter provided with an ignition plug receiving element for fixing the adapter to an ignition plug. A shock-absorbing element is arranged between the ignition coil part and the adapter and/or between the adapter and the ignition plug receiving element.

13 Claims, 4 Drawing Sheets

ATTACHABLE ROD IGNITION COIL

This application is a § 371 application of PCT/EP2004/002759, which claims priority from DE 10314063.8, filed Mar. 28, 2003.

BACKGROUND

The invention relates to an attachable rod ignition coil for a motor vehicle comprising an ignition coil component with a spark plug receptacle for attaching a spark plug.

The invention also relates to an attachable rod ignition coil comprising an ignition coil component and an adapter with a spark plug receptacle for fastening to a spark plug.

SUMMARY OF THE INVENTION

Mounting of rod ignition coils after attachment to the spark plug by threaded connection directly on the engine block in order to prevent loosening of the plug connection has been disclosed. Most recently, however, mounted rod ignition coils which permit simpler and accordingly more cost-effective assembly have been used in place of threaded-connection rod ignition coils.

Rod ignition coils are also customarily used in which fastening to the spark plug is effected by way of an intermediate adapter. The adapter is produced separately from the rod ignition coil and subsequently connected to the rod ignition coil, optionally in the assembly process only. These adapters are made in different sizes for different spark plugs or different plug shaft lengths so that the same ignition coil component may be used for all configurations. Savings are made in assembly and maintenance, since threaded connection to the engine is made superfluous in the case of these directly inserted and rigidly connected ignition coils.

It has however been found in practical application that unintended damage to the rod ignition coil may occur in exceptional cases, for example, if too much force is applied in manual assembly of rod ignition coils. Hairline cracks may appear on or in the rod ignition coil if such excessive force is applied, and as a result malfunctions may occur.

The invention is based on the problem of specifying a rod ignition coil which may be mounted by simple and reliable means without the risk of damage.

In the invention a provision is made for solution of this problem in the case of an attachable rod ignition coil of the kind indicated in the foregoing in that a shock-absorbing element is mounted in the area of the spark plug receptacle of the ignition coil component.

In addition, the problem is solved in the case of a rod ignition coil with an adapter in that a shock-absorbing element is mounted between the ignition coil component and the adapter and/or the adapter and the spark plug receptacle.

The shock-absorbing element absorbs the peak forces which have previously resulted in damage or destruction of the ignition coil component. Consequently, the rod ignition coil is relieved of mechanical stress and the impact energy or at least a significant part of the impact energy is absorbed by the shock-absorbing element. Part of the kinetic energy exerted in mounting the rod ignition coil is consumed by the work of deformation. In addition, an opposing force is generated which is noticed by the person mounting the ignition coil, with the result that this person reduces his expenditure of effort. Thus, inadvertent exertion of excessive force is avoided and damage is accordingly prevented with the attachable rod ignition coil claimed for the invention.

It is especially advantageous if the deformability of the shock-absorbing element is accompanied by energy dissipation as the rod ignition coil is mounted on the spark plug.

Even greater protection from failure is achieved if the adapter and the ignition coil component are movable relative to each other in the axial direction along a damping path. This development of the invention affords the advantage that energy may be absorbed over the entire energy damping path. The shock-absorbing element may be configured so that the attachment force increases continuously. This results in gradual transmission of force from the ignition coil component to the adapter, so that abruptly occurring power peaks which might result in damage to structural components are prevented.

Provision may be made in the case of the rod ignition coil claimed for the invention such that a plug socket is configured on the adapter or on the ignition coil component into which a plug section of the respective other part configured diametrically opposite may be introduced. The plug socket preferably is configured on the adapter. The plug section of the ignition coil component is introduced into this plug socket. Use of different adapters makes it possible to use the same ignition coil component for different spark plug alternatives or different plug shaft lengths, and this in turn results in cost savings.

In an alternative embodiment of the rod ignition coil of the invention provision may be made such that the shock-absorbing element or optionally a second shock-absorbing element is mounted in the area of the spark plug receptacle. The shock-absorbing element may be mounted either between the ignition coil component and the adapter or in the area of the spark plug receptacle of the adapter. It is also possible to combine the two alternatives so that the adapter has a total of two shock-absorbing elements. If the shock-absorbing element is mounted in the area of the spark plug receptacle, it may be comparatively simple to insert it or press it into the bottom area of the spark plug receptacle. A circumferential groove in which the shock-absorbing element may be retained may also be provided at this point.

It may be preferable for it to be possible to make the adapter of metal or a metal alloy, a brass alloy in particular, possessing good electric conductivity. Provision may also be made for combining different metals, such as a hard metal and a soft one.

It is recommended that the shock-absorbing element be mounted axially in alignment. It can perform its damping function optimally in this configuration, since it is positioned on one axis with the active attachment force.

It is preferable for it to be possible to produce the shock-absorbing element with a rubber or silicon material. In theory, however, other materials such as plastic, metal, ceramic, or sintered material with which the damping effect required may be achieved are also suitable. Different materials may also be combined; for example, a shock-absorbing element of rubber provided on one or both sides with a layer of metal is conceivable.

Particular preference is to be given to a shock-absorbing element which is electrically conductive so that it can transmit the ignition current. The occurrence of undesirable ignition sparks between the spark plug head and the mounted structural component (adapter or ignition coil component) may be effectively prevented in this way.

An especially good damping effect is obtained if the shock-absorbing element is configured as a disk or roller. Elements in these shapes fit tightly against the adapter or the ignition coil component so that good force transmission is ensured. In addition, they afford the advantage that they may be easily and cost-effectively produced.

In an alternative embodiment of the attachable rod ignition coil of the invention the shock-absorbing element may be configured as a pressure spring. The pressure spring may be moved along the damping path which is determined by the relative mobility between the adapter and the ignition coil component. When the rod ignition coil is attached to the spark plug, the shock-absorbing pressure spring is compressed as soon as the final assembly position is exceeded, so that a steadily growing opposing force is generated which prevents a mechanic from inadvertently applying excessive force when mounting the rod ignition coil. Transmission of force between the rod ignition coil or the ignition coil component and the adapter is effected mostly by way of the pressure spring, something which results in more uniform increase in force. In this way power peaks are absorbed and eliminated by the pressure spring so that damage to the structural components is excluded.

Especially reliable retention and good shock-absorption can be achieved if one end of the pressure spring may be introduced into a recess in the ignition coil component and the other end into a recess in the adapter. The pressure spring is mounted in parallel with the axis of the active attachment force and can ensure optimal performance of its shock-absorbing function.

BRIEF DESCRIPTION OF THE DRAWINGS

Other advantages and details of the invention are presented in the following descriptions of exemplary embodiments and in the drawings, in which.

Identical components are provided with the same reference numbers in FIGS. 1 to 4.

DETAILED DESCRIPTION OF THE INVENTION

Figure 1:
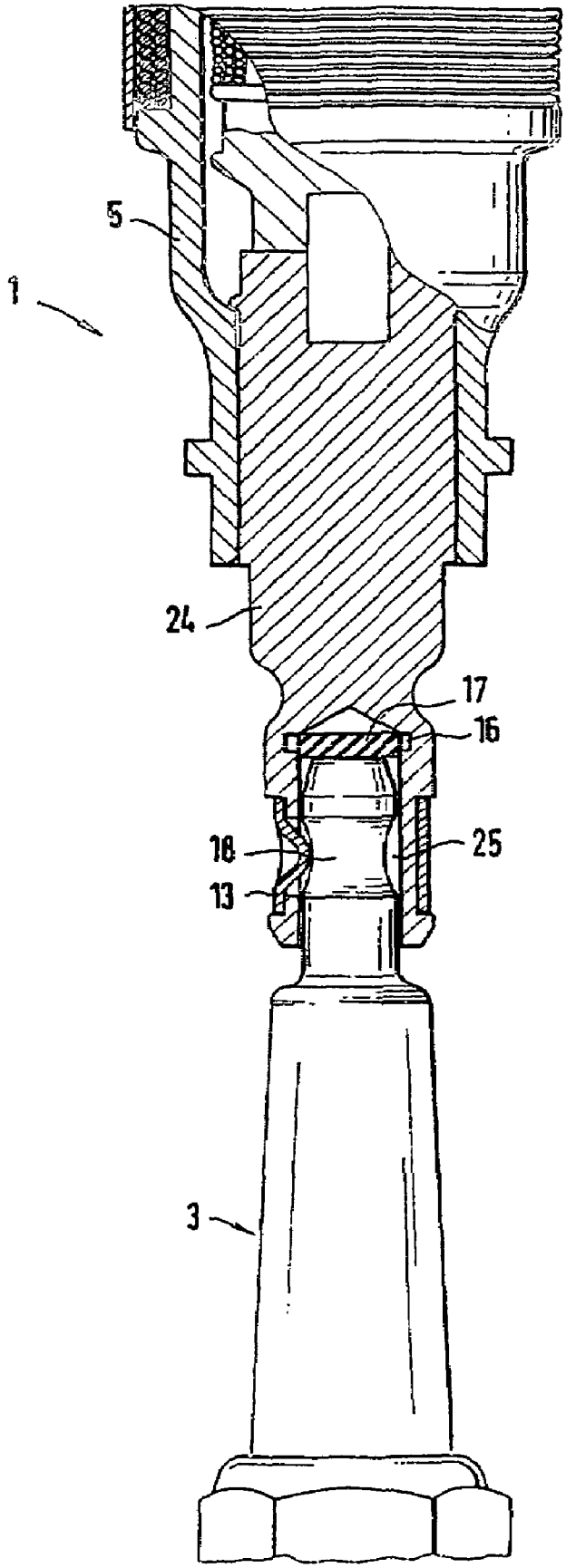
FIG. 1 presents a first exemplary embodiment of the rod ignition coil claimed for the invention, one in which the shock-absorbing element is mounted in the area of the spark plug receptacle.

FIG. 1 shows in a partly cutaway side view a first exemplary embodiment of the invention, an embodiment in which the shock-absorbing element is mounted in the area of the spark plug receptacle.

The rod ignition coil 1 consists essentially of an ignition coil component 24 which is connected to an electronic circuit (not shown) for generation of the ignition signal and a housing 5 which protects and electrically insulates the interior components. The rod ignition coil 1 is connected to other engine assemblies by cable connections not shown. At the lower end of the ignition coil component 24 there is a spark plug receptacle 25 mounted on a spark plug 3.

The ignition coil component 24 and the housing 5 of the rod ignition coil 1 are rigidly connected to each other so that impact forces which arise when the rod ignition coil 1 is mounted on the spark plug 3 are undamped when transmitted.

On the free end of the ignition coil component 24 there is a spring 13 which is clamped onto the SAE head of the spark plug 3 after assembly and which prevents inadvertent loosening of the ignition coil component 24 from the spark plug 3.

The ignition coil component 24 has, in the area of the spark plug receptacle 25, a circumferential groove 16 into which is introduced a disk-shaped shock-absorbing element 17 which is positively locked in the groove 16. The shock-absorbing element 17 is made of a rubber material which is electrically conductive.

When the rod ignition coil 1 with its ignition coil component 24 is mounted on the spark plug 3, the force is transmitted from the SAE head of the spark plug 3 to the ignition coil component 24, by way of the shock-absorbing element 17. As soon as the shock-absorbing element 17 rests on the head of the spark plug 3, a part of the energy expended in mounting the rod ignition coil 1 is converted to damping work.

Figure 2:
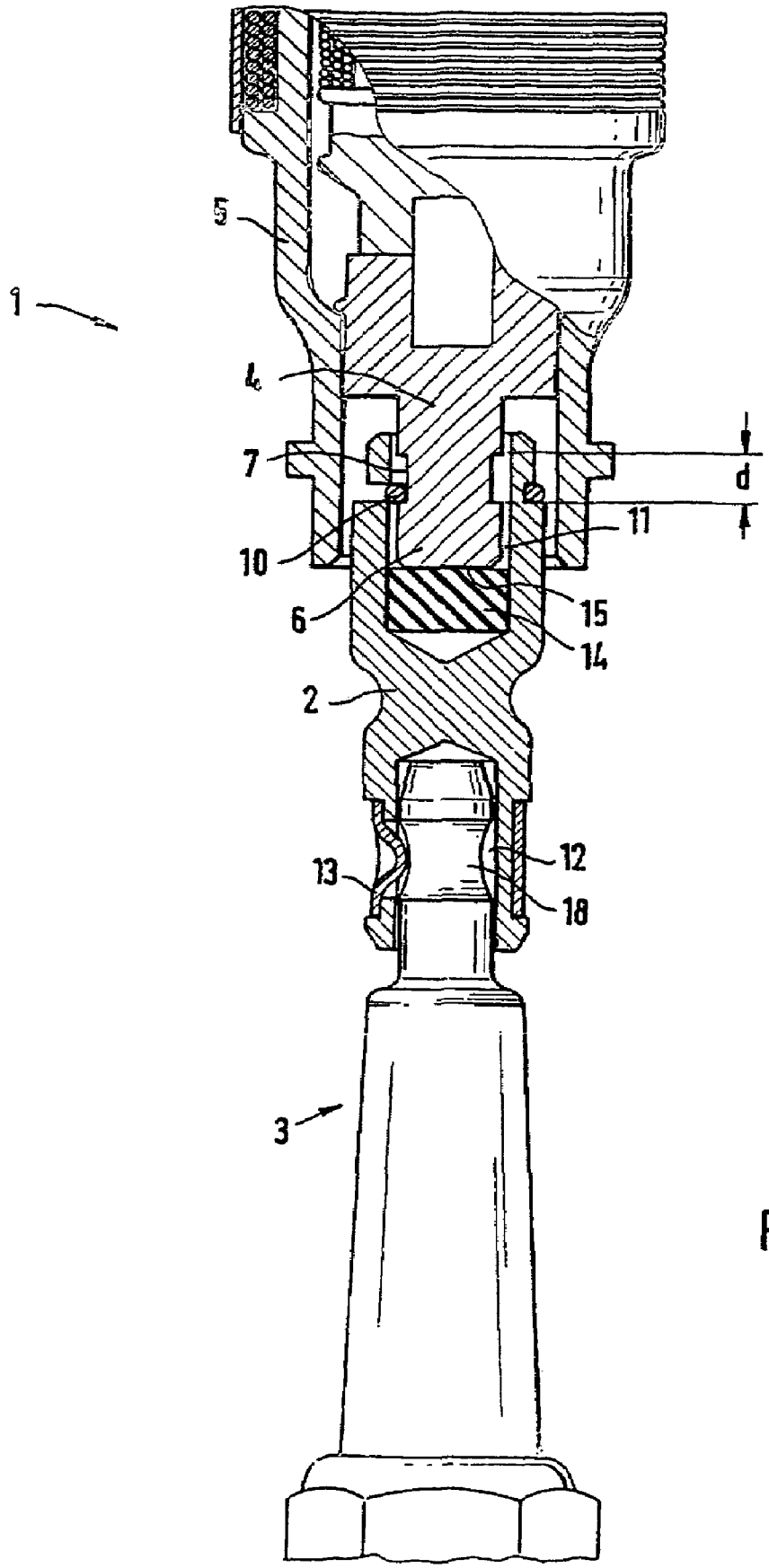
FIG. 2 a second exemplary embodiment of the rod ignition coil claimed for the invention, one in which the shock-absorbing element is mounted between the ignition coil component and the adapter.

FIG. 2 presents a second exemplary embodiment of the invention, in which the shock-absorbing element is mounted between the ignition coil component and the adapter. As is to be seen in FIG. 2, the rod ignition coil 1 is mounted with the adapter 2 on a spark plug 3. The individual components are shown in a partly cutaway side view.

The rod ignition coil 1 consists essentially of an ignition coil component 4 connected to an electronic circuit (not shown) for generation of the ignition signal and a housing 5 which protects and electrically insulates the interior components. The rod ignition coil 1 is connected to other engine assemblies by cable connections (not shown).

The rod ignition coil 1 is connected to the adapter 2 by way of a plug-in or snap-on connection 6. In the end area of the ignition coil component 4 there is a bolt-like plug section 6 which has a circumferential groove 7.

The bolt-like plug section 6 is introduced into a admission opening of the adapter 2. This plug connection is secured by a safety element 10 which is configured as a spring-loaded safety ring in the exemplary embodiment illustrated. FIG. 2 shows, to the right of an imaginary center line, that the safety element is held in a groove on the exterior of the adapter 2. It is shown, to the left of an imaginary center line, that this groove in the adapter 2 is interrupted over one section, so that the spring-loaded safety element 10 is positioned at this point inside the admission opening of the adapter 2 and reduces the cross-section of the latter. When the adapter 2 is plugged into the plug section 6 of the ignition coil component 4, the safety element is initially forced outward until it is positioned in the groove 7 of the plug section after attachment. This prevents inadvertent loosening of the two components, and at the same time the plug section 6 of the ignition coil component 4 and the adapter 2 may be moved vertically relative to each other. The displacement distance corresponds to the width of the groove 7 identified by the letter d in FIG. 2. This distance is used during mounting of the rod ignition coil 1 on the spark plug 3 to absorb the impact generated during assembly. The path d typically amounts to 2 mm.

In its upper area the adapter 2 is configured as a plug socket 11 whose diameter is adapted to the diameter of the plug section 6. In the exemplary embodiment illustrated, the plug socket 11 is circular in cross-section. The opposite side of the adapter 2 is configured as a spark plug receptacle 12. A spring 13 which after installation is positively locked on the SAE head of the spark plug 3 and prevents disengagement of the adapter from the spark plug 3 is positioned in a section along the circumference of the adapter 2.

A shock-absorbing element 14 is mounted between the end of the plug section 6 and the bottom of the plug socket 11. This element 14 is in the form of a thick disk the circumference of which rests against the interior of the plug socket 11. The shock-absorbing element 14 is made of a rubber material.

When the rod ignition coil 1, which is connected to the adapter 2, is mounted on the spark plug 3, force is transmitted from the ignition coil component 4 to the adapter 2 by way of the safety element 10. Since the ignition coil component 4 and the adapter 2 are not rigidly connected to each other, at first a virtually force-free relative displacement occurs which proceeds from the position shown in FIG. 2 and in the course of which the plotted damping path d is reduced, since the plug section 6 moves farther into the adapter 2. Since the front surface 15 of the plug section 6 rests on the upper surface of the shock-absorbing element 14, the plug section 6 may be inserted farther into the plug socket 11 of the adapter 2 only if the shock-absorbing element 14 is simultaneously compressed. In this way a part of the energy expended for mounting the rod ignition coil 1 is converted to the work of damping. High force peaks which usually occur on the impact of two bodies are prevented. At the same time an increasing opposing force is generated which is detected by the person mounting the rod ignition coil 1. This power rise is consequently interpreted by the person as a signal that the rod ignition coil has been properly mounted.

The ignition coil component 4 may continue to be forced into the plug socket until the safety element 10 strikes the upper edge of the groove 7. Force may be transmitted in this way from the ignition coil component 4 by way of the safety element to the adapter 2.

Figure 3:
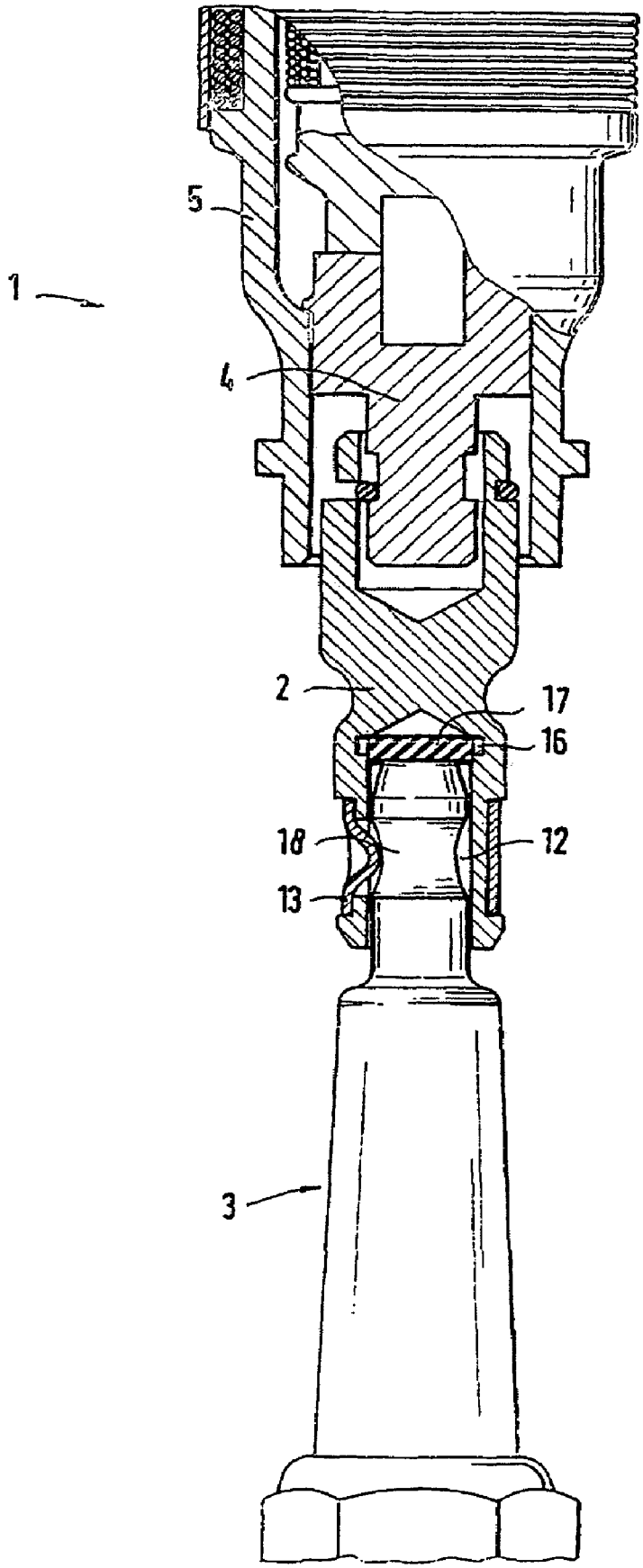
FIG. 3 a third exemplary embodiment of the rod ignition coil claimed for the invention, one in which the shock-absorbing element is mounted in the spark plug receptacle.

FIG. 3 presents a third exemplary embodiment of the invention, one in which the shock-absorbing element is configured in the spark plug receptacle. The adapter 2 has, in the area of the spark plug receptacle 12, a circumferential groove 16 into which a disk-shaped shock-absorbing element 17 is introduced. The shock-absorbing element 17 is retained in the groove 16 by positive locking. Since the shock-absorbing element 17 is appreciably thinner than the shock-absorbing element 14, the damping path is also correspondingly reduced. The position selected for the shock-absorbing element 17 inside the spark plug receptacle 12 is such that this element after installation rests against the front side of the SAE head 18 of the spark plug 3. As an alternative it is also possible to deliver the shock-absorbing element 17 separately from the adapter 2 so that the customer or mechanic who mounts the rod ignition coil must first secure the shock-absorbing element 17 in the spark plug receptacle 12 of the adapter 2. Preference is given, however, to provision of the adapter 2 together with the shock-absorbing element 17 by the manufacturer.

When the rod ignition coil 1 is mounted, force is transmitted from the ignition coil component 4 by way of the safety element 10 to the adapter 2. When the shock-absorbing element 17 comes into contact with the head 18 of the spark plug receptacle inside the spark plug receptacle 12, the impact is damped so that no heavy blow is transmitted to the sensitive component of the rod ignition coil 1.

Figure 4:
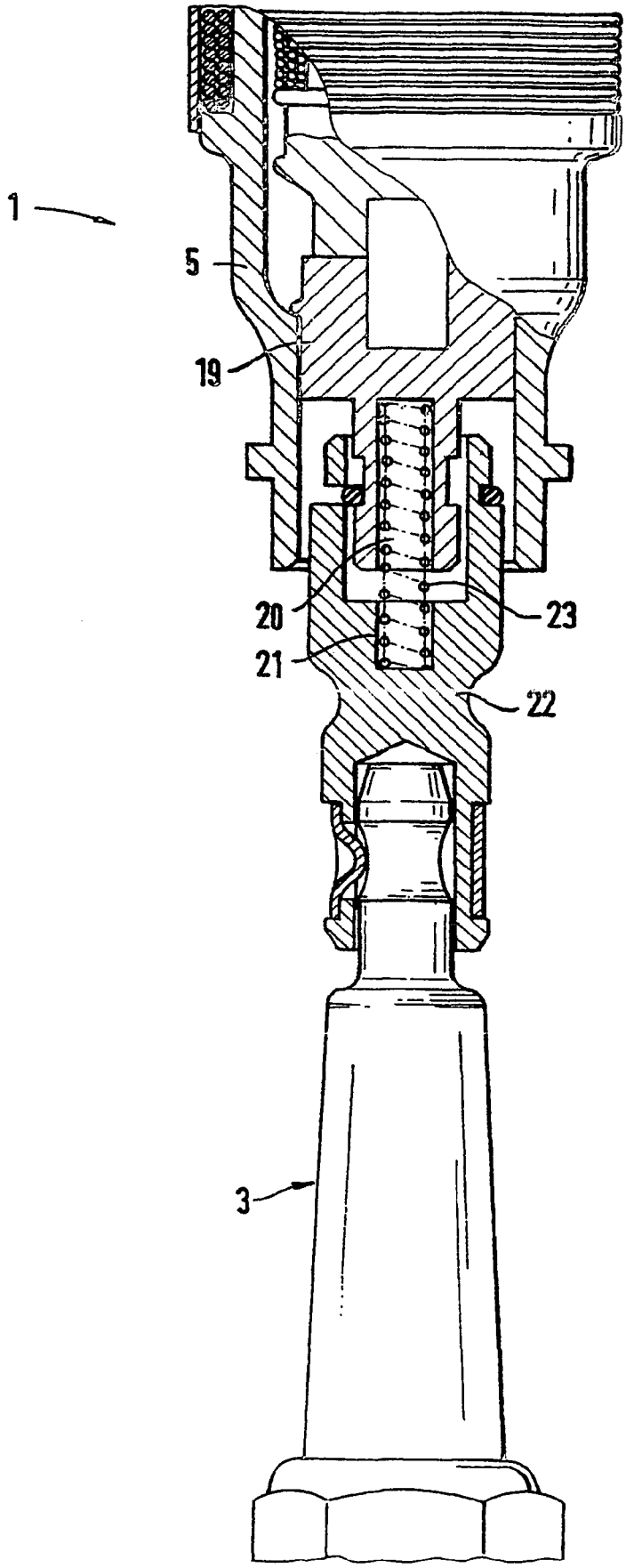
FIG. 4 a fourth exemplary embodiment of the rod ignition coil claimed for the invention, in which the shock-absorbing element is configured as a pressure spring.

FIG. 4 presents a fourth exemplary embodiment of the invention, in which the shock-absorbing element is configured as a pressure spring. The ignition coil component 19 has a central recess 20 which is positioned opposite a recess 21 in the adapter 22 after installation. The ignition coil component 19 is connected to the adapter 22 by way of the safety element 10. A pressure spring 23 which exerts compressive force on the front surfaces of the recesses 20 and 21 is introduced into the free space formed by the recesses 20 and 21. Electrical connection of the ignition coil component 19 with the adapter 22 by way of the pressure spring 23 at all times is ensured by a certain initial stressing force built into the pressure spring 23. The ignition current flows by way of the pressure spring 23 during operation. Should an impact or power peak occur during assembly, such event may be contravened by compression of the pressure spring 23, which absorbs a part of the impact energy. A part of the energy is destroyed as a result of damping by the material, while the remainder of the energy is then converted back to work of displacement by the extension of the pressure spring 23.

The invention claimed is:

1. An ignition coil component attachable to a spark plug, comprising:

electrically conductive means connected to said ignition coil component provided with a socket for receiving a spark plug; and shock absorbing means disposed in said socket engageable by said spark plug upon insertion thereof in said socket, wherein said electrically conductive means includes means for yieldably attaching said spark plug to said electrically conductive means when said spark plug is received in said socket in engagement with said shock absorbing means.

2. A component according to claim 1 wherein said shock absorbing means is electrically conductive.

3. A component according to claim 1 wherein said shock absorbing means comprises at least one material selected from the group consisting of plastics, rubber, silicon metal, ceramic and sintered material.

4. An ignition coil attachable to a spark plug, comprising:

electrically conductive means connected to said ignition coil component provided with a socket for receiving a spark plug; and shock absorbing means disposed in said socket engageable by said spark plug upon insertion thereof in said socket, wherein said socket of said electrically conductive means includes a peripheral recess for receiving a portion of said shock absorbing means and thereby retaining said shock absorbing means in said socket of said electrically conductive means.

5. A component according to claim 4 wherein said shock absorbing means is provided with a disk-shaped configuration.

6. An ignition coil component attachable to a spark plug, comprising:

an adapter mounted on said component and displaceable relative thereto along a line of traverse, having a socket disposed therein for receiving the head portion of said spark plug; and shock absorbing means disposed on said line of travel between said adapter and one of said component and said head portion of said spark plug when said head portion is received within said socket, wherein said adapter includes a second recess disposed along said line of travel, said component includes a portion received in said second recess and said shock absorbing means is disposed in said second recess between said portion of said component and said adapter.

7. A component according to claim 6 wherein said adapter includes means for detachably securing said head portion of said spark plug in said second recess.

8. A component according to claim 6 wherein said adapter is formed of an electrically conductive material.

9. A component according to claim 6 wherein said shock absorbing means is formed of an electrically conductive material.

10. A component according to claim 6 including a second shock absorbing means disposed between said component and said adapter.

11. A component according to claim 6 wherein said second shock absorbing means comprises an annular member received in annular recesses in said component and said adapter.

12. An ignition coil component attachable to a spark plug, comprising:

an adapter mounted on said component and displaceable relative thereto along a line of travel, having a socket disposed therein for receiving the head portion of said spark plug; and shock absorbing means disposed on said line of travel between said adapter and one of said component and said head portion of said spark plug when said head portion is received within said socket, wherein said adapter having a recess includes an annular recess and said shock absorbing means is retained in said annular recess.

13. A component according to claim 6 wherein said shock absorbing means comprises a spring.

* * * * *